US005290337A

United States Patent [19]

Sharma

[11] Patent Number: 5,290,337

[45] Date of Patent: Mar. 1, 1994

[54] PYROCHEMICAL PROCESSES FOR PRODUCING PU, TH AND U METALS WITH RECYCLABLE BYPRODUCT SALTS

[75] Inventor: Ram A. Sharma, Troy, Mich.

[73] Assignee: General Motors Corporation, Detroit, Mich.

[21] Appl. No.: 941,959

[22] Filed: Sep. 8, 1992

[51] Int. Cl.[5] ..... C22B 60/02

[52] U.S. Cl. ..... 75/393; 75/395; 75/397; 75/399; 423/5; 423/21.1; 423/155; 204/61; 204/70; 204/130; 204/1.5

[58] Field of Search ..... 75/395, 397, 399, 393; 204/1.5, 61, 70, 130, 293, 294; 423/5, 21.1, 155; 252/626

[56] References Cited

U.S. PATENT DOCUMENTS

| | | | |
|---|---|---|---|
| 3,109,731 | 11/1963 | Knighton | 75/395 |
| 3,119,686 | 1/1964 | Teitel | 75/399 |
| 4,048,026 | 9/1977 | Greinacher | 204/61 |
| 4,192,724 | 3/1980 | Minami et al. | 204/67 |
| 4,534,792 | 8/1985 | Elliott | 75/399 |
| 4,636,250 | 1/1987 | Elliott | 75/398 |
| 5,024,737 | 6/1991 | Claus et al. | 204/71 |
| 5,089,094 | 2/1992 | Ogasawara et al. | 204/70 |
| 5,118,396 | 6/1992 | Claus et al. | 204/64 R |
| 5,198,078 | 3/1993 | Gale et al. | 204/70 |

*Primary Examiner*—Donald P. Walsh
*Assistant Examiner*—Ngoclan T. Mai
*Attorney, Agent, or Firm*—George A. Grove; Domenica N. S. Hartman

[57] ABSTRACT

In the pyrochemical reduction of uranium dioxide or other actinide metal oxides by reaction with magnesium, magnesium oxide byproduct is produced. The use of a salt flux comprising magnesium chloride and a rare earth element trichloride such as neodymium chloride is disclosed. The neodymium chloride reacts with magnesium oxide to form magnesium chloride and neodymium oxychloride. The resulting magnesium chloride-neodymium oxychloride salt mixture can readily be subjected to electrolysis to regenerate magnesium and neodymium chloride for reuse in the pyrochemical reduction process. Other uses of the magnesium chloride-neodymium chloride salt flux are also proposed.

3 Claims, No Drawings

PYROCHEMICAL PROCESSES FOR PRODUCING PU, TH AND U METALS WITH RECYCLABLE BYPRODUCT SALTS

This invention pertains to the chemical reduction of actinide metal oxides with magnesium metal to produce magnesium oxide and actinide metals. More specifically, this invention pertains to such a chemical reduction practice when it is carried out in a molten salt flux and it is desired to recover and recycle the magnesium oxide byproduct. In a more general sense, this invention is also applicable to the processing and electrochemical reduction of magnesium oxide in a molten salt bath.

BACKGROUND OF THE INVENTION

Pyrochemical processes are known to produce uranium (U), thorium (Th) and plutonium (Pu) metals by the reduction of their respective oxides using magnesium in the presence of a molten salt flux. Often in such processes, a separate molten metal pool is employed for the recovery of the actinide metal from the molten salt phase. The flux is used to suspend the actinide metal oxide and the byproduct magnesium oxide during the reaction, and the heavier metallic pool is used to extract the metal produced. When I refer to the term "suspend" in the context of these processes, I mean that the molten salt flux may either dissolve the actinide metal oxide and/or the magnesium oxide or it may suspend the oxide as fine particles.

The chemistry of such pyrochemical reduction reactions is well known. At a suitable temperature, e.g., 700° C., the actinide metal oxide reacts with a chemically equivalent amount of magnesium to form the respective actinide metal and magnesium oxide. For example, uranium dioxide ($UO_2$) reacts with two moles of magnesium to form two moles of magnesium oxide plus the product, one mole of substantially pure uranium. As has been practiced, a suitable salt flux for this magnesium reduction practice may, for example, consist of magnesium chloride and magnesium fluoride with the optional presence of other alkali and alkaline earth chlorides or fluorides. The molten metallic recovery pool typically initially consists essentially of zinc and magnesium or copper and magnesium. This metallic pool is present at the reaction temperature as a separate and separable liquid phase with respect to the salt flux reaction medium. The pool contains magnesium in suitable quantity for the chemical reduction of the uranium, thorium and/or plutonium oxide. As the magnesium is consumed in the reduction of e.g. $UO_2$ the byproduct uranium metal enters the pool. Zinc or copper is miscible with both uranium and magnesium and keeps the metal phase liquid and mobile at the reaction temperature.

These practices are suitable for obtaining relatively pure amounts of the respective actinide metal or metals in high yield. The reactions are usually batch reactions. They are carried out until the actinide oxide(s) are completely reduced. At this point, the reaction stops and stirring is terminated, and a phase separation is carried out to remove the metal recovery pool from the flux. The actinide metal is recovered by distilling or otherwise removing the zinc or copper melting point depressant.

In this reduction practice, magnesium oxide particles are suspended in but not dissolved in the salt flux. This oxide/salt mixture is often radioactive. It presents a disposal problem because it is difficult to recover or recycle the magnesium oxide. In order to recover magnesium metal from the magnesium oxide, it is usually necessary to separate the oxide from the salt and convert the magnesium oxide to magnesium chloride for electrolytic reduction. Heretofore, such separation, conversion and reduction have been difficult and expensive.

It is an object of this invention to provide a practice and a salt flux composition that readily facilitates the conversion of magnesium oxide produced in such pyrochemical reductions of actinide oxides so that the recycle of the salts and recovery and recycle of magnesium metal is readily accomplished. While my practice is specifically applicable to the recovery of magnesium from magnesium oxide byproduct in the pyrochemical reduction of actinide metal oxides, it will be appreciated that there are other applications in which it is desired to convert magnesium oxide to a magnesium salt or to recover magnesium from magnesium oxide. In fact, a principal application may well be the production of magnesium metal from magnesium oxide. In accordance with a preferred embodiment of my invention, these and other objects are accomplished as follows.

BRIEF SUMMARY OF THE INVENTION

For purposes of illustration, I will describe the practice of my invention as applied to the reduction of uranium dioxide, $UO_2$, with magnesium. Instead of the molten salt flux described above in connection with the practice of the prior art process, I use a mixture of magnesium chloride and a rare earth element chloride in the approximate molar proportions of one-third magnesium chloride and two-thirds rare earth chloride. Any suitable rare earth metal chloride may be used. The use of neodymium trichloride is an example. A suitable salt flux composition consists of 38.7 mole percent $MgCl_2$ and 61.3 mole percent $NdCl_3$.

In addition to this molten flux mixture, I employ a molten metal phase consisting essentially of zinc with about four weight percent magnesium. The salt phase and this metal alloy phase are both liquid at about 700° C., which is a suitable temperature for the conduct of the reaction. A portion of the magnesium content of the molten metal recovery phase serves as the reductant in the reaction. A quantity of solid, dry uranium dioxide powder is added to the mixture. Preferably, an excess of magnesium with respect to actinide oxide is used. The $UO_2$ is suspended in the molten salt phase, and the three phases are stirred together at about 700° C. for a suitable period of time such as about one to two hours. At the completion of the reduction, the stirring is stopped, and the molten metal phase is separated by any suitable practice from the salt phase.

In the course of the reduction reaction between magnesium and uranium dioxide, magnesium oxide is generated. However, in accordance with my invention, instead of the magnesium oxide accumulating in the bath, it reacts substantially instantaneously with the neodymium chloride to form neodymium oxychloride and magnesium chloride. Thus, at the end of the reduction reaction, the uranium metal is present with zinc and magnesium in a molten metal phase. The salt composition now is composed of approximately 60 to 65 mole percent magnesium chloride and the balance neodymium oxychloride. This salt flux is less dense than the uranium-zinc-magnesium metallic pool and will float on top of the pool until the metal pool is removed. The uranium is readily recovered from the uranium-zinc-magnesium mixture by the evaporation of the zinc and magnesium.

The salt phase is then transferred to a suitable vessel such as a refractory-lined steel pot. A graphite anode and a mild steel cathode are employed. The salt is heated to a temperature of about 700° C. The magnesium chloride-neodymium oxychloride mixture is molten. There is no initial metal pool. A suitable electrical potential is applied between the electrodes. An electrochemical reaction takes place in which magnesium chloride is presumably electrolyzed into magnesium metal and chlorine. The magnesium metal separates as a liquid. It is lower in density than the salt, and it floats on top of the salt phase. The chlorine reacts with the carbon anode and the neodymium oxychloride to form neodymium chloride and carbon monoxide or carbon dioxide gas which is evolved from the system. Thus, this electrochemical reaction and the concomitant reaction between the chlorine gas and the neodymium oxychloride serves to decompose the magnesium chloride formed by the magnesium oxide-neodymium chloride reaction, regenerating magnesium. The neodymium oxychloride is reconverted to neodymium chloride. Thus, in the practice of my invention, the original magnesium chloride-neodymium chloride salt flux is essentially regenerated with the concomitant production of magnesium liquid. Except for the small handling losses, these materials are substantially suitable for reuse in the reduction of additional actinide oxide material.

Other objects and advantages of my invention will be understood in a more complete description thereof which follows.

DETAILED DESCRIPTION OF THE INVENTION

As stated above, pyrochemical reductions utilizing magnesium have been carried out on a number of actinide metal oxides such as uranium oxide, thorium oxide and plutonium oxide. In the case of uranium, there is more than one oxide that may be reduced by this practice. However, for purposes of illustration, the practice of the invention will be described in the context of the reduction of $UO_2$. The practice will be described in the context of laboratory-size apparatus, but the process is readily scaled up and carried out in larger chemical processing equipment.

The pyrochemical reduction may be carried out in a baffled tantalum crucible contained in a furnace well disposed in a helium atmosphere glove box. A flange serves to cover the furnace well. The flange may have openings through which a tantalum stirrer extends, together with a thermocouple protection tube and a sampling tube. All of these apparatus implements extend to the lower reaches of the tantalum crucible. The stirrer may have a simple flat blade and be rotated by a direct current motor. The furnace well and the reduction crucible may be heated by a resistance furnace, suitably a three-zone electrical resistance furnace. The temperature of the furnace and the contents of the crucible are controlled by an electrical controller.

A zinc-magnesium molten alloy phase is first prepared in the crucible. Four hundred grams of the alloy consisting of 380 grams of zinc and 20 grams of magnesium (5 weight percent magnesium) is prepared. The alloy is molten and maintained at 750° C. Salt flux mixture consisting of 110 grams of a 43.7 mole percent magnesium chloride-56.3 mole percent neodymium chloride is added to the crucible. The mixture of liquid flux and metal phase is heated at 750° C., and the mixture is stirred.

Forty-five grams of uranium oxide powder is added to the mixture, and the reduction is carried out at 750° C. by stirring over a period of about 90 minutes. At the end of the reaction, the salt flux now consists of approximately 64 mole percent magnesium chloride and 36 mole percent neodymium oxychloride. A portion of the magnesium from the zinc magnesium alloy has reacted with the uranium dioxide to form magnesium oxide. Magnesium oxide in turn reacts with neodymium chloride almost instantaneously to form neodymium oxychloride. The uranium metal enters the zinc-magnesium metal phase.

Stirring is stopped and the phases separate with the heavier metal phase on the bottom. Upon solidification, the salt flux is separated by breaking or cutting it away from the metal phase. It will be appreciated that in a larger scale operation the metal phase could be simply drained from the bottom of the vessel to separate it from the salt phase.

The uranium metal is readily separated from the zinc and magnesium by evaporating the lower boiling point metals. However, the recovery of uranium metal is not the principal focus of this invention or this disclosure. The purpose is to provide a practice by which the magnesium, which has now been converted to magnesium chloride in the salt flux mixture, may be recovered from the salt flux so that both the magnesium and the salt flux can be reused in a further pyrochemical reduction of actinide metal oxides.

The magnesium chloride-neodymium oxychloride salt flux is transferred to a mild steel vessel serving as an electrolytic cell. The cathode of the electrolytic cell is also made of mild steel. A graphite anode is used. In this low volume scale practice, the cell may be contained in a suitable hood because small amounts of chlorine and carbon monoxide may be generated. With respect to a larger scale operation, electrolytic processes and apparatus for the electrolytic reduction of magnesium chloride are known. Apparatus of the same type may be employed in my practice. The contents of the cell are heated to about 700° C. An electrical potential is applied between the anode and cathode at a suitable value greater than the electrochemical decomposition potential of magnesium chloride—about 2.6 volts per cell. Magnesium is generated at the cathode by the reduction of magnesium cations to magnesium metal, and it floats as a liquid on the surface of the electrolyte. Neodymium oxychloride is concomitantly converted back to neodymium chloride. This occurs by an interaction of the chlorine gas produced from the reduction of magnesium chloride and the neodymium oxychloride at the carbon anode. Gas is evolved in the process. Carbon monoxide is evolved which soon oxidizes to carbon dioxide in air. In summary, a portion of the magnesium chloride in the spent salt flux is converted to magnesium metal, which is easily separated from the salt phase because it floats as a lower density liquid on top of the molten salt. Neodymium oxychloride produced in the pyrochemical reduction reaction is converted back to neodymium chloride, and the resulting neodymium chloride-magnesium chloride mixture is suitable for reuse in the pyrochemical reduction of uranium oxide or other actinide metal oxide.

Thus, it is seen that my practice provides a method of readily regenerating the magnesium metal reductant that is used in the above-described pyrochemical reduction reaction. At the same time, my method provides a practice for the recovery of the spent neodymium oxychloride component of the salt flux. It is this unique combination of the salt flux constituents which enables the advantageous practice of my invention. By using magnesium chloride in combination with a suitable rare earth element chloride such as neodymium chloride, it is possible to instantaneously convert magnesium oxide produced in the reduction reaction to magnesium chloride, which is, of course, soluble in the salt phase. Therefore, there is no separate sludge-forming magnesium oxide phase to be dealt with during the actinide oxide reduction reaction. Thus, the byproduct salt mixture typically comprising magnesium chloride, unreacted neodymium chloride and neodymium oxychloride can be suitably subjected to electrochemical electrolysis of the magnesium chloride. This regenerates magnesium from the magnesium chloride in an amount desired to recover the spent magnesium metal reductant. It also regenerates neodymium chloride by reducing neodymium oxychloride to neodymium chloride.

While my invention has been contemplated and developed for use in the pyrochemical reduction of actinide metal oxides, it will be appreciated that the utility of may invention also lies in the reduction of magnesium oxide to produce magnesium metal. My salt flux may also be used in any chemical processing situation in which magnesium oxide is produced and presents a processing problem.

In the case of the production of magnesium metal, a salt flux comprising magnesium chloride, neodymium chloride (or other suitable rare earth element chloride) and optionally other salts such a magnesium fluoride and/or lithium chloride is employed. When this mixture is employed in an electrolysis cell at a temperature on the order of 650° C. to 800° C. and magnesium oxide is added, it is immediately converted to magnesium chloride by reaction with the neodymium chloride. Neodymium oxychloride is again formed as a byproduct. By utilizing a suitable anode material such as graphite and a suitable cathode material such as mild steel and an electrical potential of the order of 5 to 10 volts per cell, the magnesium chloride is electrolytically reduced as described above to produce magnesium metal. It can be produced at the rate that magnesium oxide is added to the flux. At the same time that the neodymium oxide is reacting with the magnesium chloride to produce neodymium oxychloride, the neodymium oxychloride can also be converted as part of the electrolysis process back to neodymium chloride. Thus, my process can readily be used to continually convert magnesium oxide to magnesium metal by use of the above-described electrolysis and concomitant chemical reaction practice. The rare earth chloride which is essential to the reaction with magnesium oxide is converted to rare earth oxychloride, but it is reduced back to the rare earth chloride at the anode in the electrolysis cell.

Similarly, the use of my magnesium chloride-rare earth chloride salt flux is beneficial in other processing situations where magnesium oxide is formed and constitutes a problem because of its insolubility in other present salt or metal phases. The magnesium oxide reacts substantially instantaneously with the rare earth chloride employed in my salt flux and is converted to magnesium chloride, which is miscible with the rare earth chloride.

While my invention has been described in terms of a few specific embodiments thereof, it will be appreciated that other forms could readily be adapted by one skilled in the art. Accordingly, the scope of my invention is to be considered limited only by the following claims.

The embodiments of the invention in which an exclusive property or privilege is claimed are defined as follows:

1. In the process of the chemical reduction of actinide metal oxide by reaction with magnesium metal to form the corresponding actinide metal and magnesium oxide, said process comprising suspending the actinide oxide in a molten salt flux, reacting the actinide oxide with magnesium metal to form actinide metal and magnesium oxide, collecting the actinide metal into a separate and separable liquid metal phase, and suspending the byproduct magnesium oxide in the molten salt flux, such reaction being continued until the actinide metal oxide is reduced, whereupon the liquid metal phase is separated from the salt flux for recovery of the actinide metal, the improvement to said process facilitating the recycling of the byproduct salts and oxide to recover magnesium metal comprising employing as said reduction reaction medium flux a mixture consisting essentially of magnesium chloride and a rare earth element trichloride, whereby the byproduct magnesium oxide reacts as it is formed with said rare earth trichloride to form a salt mixture comprising magnesium chloride and rare earth oxychloride, separating the magnesium chloride-rare earth oxychloride-containing salt mixture from the actinide metal product and thereafter subjecting the magnesium chloride-rare earth oxychloride-containing salt mixture to electrolysis to produce magnesium metal and convert the rare earth oxychloride to rare earth trichloride.

2. A method as recited in claim 1 where the magnesium chloride-rare earth oxychloride-containing salt mixture is subjected to electrolysis utilizing a carbon-based anode and an iron-based cathode.

3. A method as recited in claim 1 where the rare earth element trichloride that is employed is $NdCl_3$.

* * * * *